US005141192A

United States Patent [19]

Adams

[11] Patent Number: 5,141,192

[45] Date of Patent: Aug. 25, 1992

[54] APPARATUS FOR HANGING CORDS FROM A GUTTER OR THE LIKE

[75] Inventor: William E. Adams, Butler County, Pa.

[73] Assignee: Adams Mfg., Portersville, Pa.

[21] Appl. No.: 305,692

[22] Filed: Feb. 3, 1989

[51] Int. Cl.[5] ..... F21V 21/00

[52] U.S. Cl. ..... 248/231.8; 248/316.7; 248/301; 248/229; 248/48.1

[58] Field of Search ..... 248/65, 301, 74.2, 316.7, 248/300, 304, 48.1, 215, 339, 229, 231.8; 24/710.5; 362/249

[56] References Cited

U.S. PATENT DOCUMENTS

| | | | |
|---|---|---|---|
| D. 34,263 | 3/1901 | Bailey . | |
| D. 99,713 | 5/1936 | Hasse . | |
| D. 143,792 | 2/1946 | Bixby . | |
| D. 272,887 | 3/1884 | Parton . | |
| 321,180 | 6/1885 | Berger | 248/48.1 |
| 350,909 | 10/1886 | Berger | 248/48.1 |
| 441,429 | 11/1890 | Mahin | 248/48.1 |
| 1,726,316 | 8/1929 | Saxton | 248/215 |
| 1,730,959 | 10/1929 | Warfield, Sr. | 248/316.7 |
| 1,866,691 | 7/1932 | Worley, Jr. et al. . | |
| 2.018,836 | 10/1935 | Clemence . | |
| 2.073,172 | 3/1937 | Posnack | 248/300 X |
| 2,802,250 | 8/1957 | Klotz | 248/316.7 X |
| 3,011,049 | 11/1961 | Kinghorn . | |
| 3,189,310 | 6/1965 | Trueson . | |
| 3,193,229 | 7/1965 | Stock | 248/74.2 |
| 3,204,090 | 8/1965 | Kvarda, Jr. . | |
| 3,275,818 | 9/1966 | Campbell . | |
| 3,386,590 | 6/1968 | Gretz | 248/235 X |
| 3,540,687 | 11/1970 | Cuva . | |
| 4,123,900 | 11/1978 | Sadowski | 248/339 X |
| 4,244,014 | 1/1981 | Van Ess . | |

FOREIGN PATENT DOCUMENTS

| | | | |
|---|---|---|---|
| 74411 | 7/1952 | Denmark | 248/303 |

*Primary Examiner*—Alvin C. Chin-Shue
*Attorney, Agent, or Firm*—Buchanan Ingersoll

[57] ABSTRACT

The invention relates to a hook having a spiral, curved in such a way so as to exert pressure on most curved or bent surfaces, such as a rain gutter, from which it may be hung. The hook is designed to have a wire of Christmas lights or other type of cord passed through the opposite end. In operation, the hook is held tightly against the gutter wall by the curvature of its spiral shape. The disclosed technique allows the application and removal of the device and Christmas lights without using a ladder or requiring any permanent modification of the home.

6 Claims, 1 Drawing Sheet

APPARATUS FOR HANGING CORDS FROM A GUTTER OR THE LIKE

BACKGROUND OF THE INVENTION

1. Field of the Invention

The present invention relates to a device for suspending a cord or wire from a gutter lip or other near-vertical support. More specifically, the invention relates to a hook for suspending Christmas lights on a wire from the gutter lip while standing on the ground.

2. Description of the Prior Art

A large number of hooks and hangers for cords, wires, and especially Christmas lights have been proposed in the past. *Many of these hooks are removable.* Others are utilized for hanging Christmas lights that contemplate a permanent addition of part or all of the device to the house itself. Examples of these permanent or semi-permanent installations are: Trueson, U.S. Pat. No. 3,189,310, Kvarda, U.S. Pat. No. 3,204,090, Van Ess, U.S. Pat. No. 4,244,014, Campbell, U.S. Pat. No. 3,275,818, and Cuva, U.S. Pat. No. 3,540,687, which all disclose various methods for mounting Christmas lights on a wire to a house. Each of the above patents requires some permanent or semi-permanent modification of the house itself, by affixing all or a portion of the device to the house. The use of these devices is time consuming and laborious, and removal is equally complicated.

Removable hooks have several important aspects, primarily ease of use and removal, combined with stability during attachment to the gutter. The use of curved or shaped hooks, both for Christmas lights and other cord fastening, is well known. A number of devices, exemplified by Bailey, U.S. Design Pat. No. 34,263, Worley, et. al., U.S. Pat. No. 1,866,691, Parton, U.S. Design Pat. No. 272,887, and Kinghorn, U.S. Pat. No. 3,011,049, are generally useful for this purpose. None of the devices, however, are particularly adaptable for use on a gutter, nor can they be applied to the gutter while the user is standing on the ground.

Additionally, a number of the hook or clamp devices which are designed for use with Christmas lights are not capable of orienting themselves on a gutter, or if adapted for a gutter, cannot be utilized on a wide variety of curved surfaces. These devices are exemplified by Stock, U.S. Pat. No. 3,193,229, Clemence, U.S. Pat. No. 2,018,836, Bixby, U.S. Design Pat. No. 143,792, and Haase, U.S. Design Pat. No. 99,713.

The primary problem with mounting a clamp or hook on a gutter is the peculiar shape of most gutter lips. As illustrated in FIG. 3 of Stock, U.S. Pat. No. 3,193,229 and FIG. 4 herein, the trough of the gutter extends in a curved manner upwardly, with a boxed shaped lip having a right angle at the termination point. It is the attachment of the hook or clamp around this boxed end which has prevented prior hooks from being mounted with the user being on the ground. Prior to this invention, the user had to manually clip a hook around the boxed end, which usually entailed some clamping or spreading of the device. This is particularly illustrated by Stock, U.S. Pat. No. 3,193,229. The boxed termination of the gutter lip also prevents the use of hooks and clamps not intended for use on a gutter from being so utilized. The restraining portion of the hook must have a carefully shaped space to allow for this particular gutter lip. This is important both in the actual mounting of the device and the retention of the device on the gutter while in use. The clips of Kinghorn, U.S. Pat. No. 3,011,049; Bailey, U.S. Design Pat. No. 34,263; Clemence, U.S. Pat. No. 2,018,836 and Worley, Jr., U.S. Pat. No. 1,866,691 all fail in this particular respect.

SUMMARY OF THE INVENTION

A device is provided for mounting a cord or wire on a gutter and similar structures comprising a ribbon-shaped body member having a front face, a rear face and two ends, preferably formed from a single plastic member. The body member may also have a boss, extending from the front face of the body member, having a hole therethrough.

One end of the device has a hook, or, more particularly, a loop-shaped curve having an opening so as to allow a cord to pass therethrough. The hook end is designed to retain a wire of Christmas lights, and is generally sized so as to accommodate at least one cord and a rod therethrough around which the entire device may be rotated. A small projection may also be provided on the body of the hook to prevent slippage of the wires from the hook end. The second end of the device has a spiral curvature with a proximal point adjacent to the body, the spiral end forming a curve whereby the spiral continues beyond the proximal point. The device is thus adapted to fit over a portion of a gutter lip passed between the proximal point and the body, wherein the device has sufficient size, shape and resilience to enable the spiral end to grip the gutter lip.

A method for mounting a cord on a gutter lip and similar structures is also disclosed. First, in the device described above, a cord is passed through the hook end of the device. Next, a horizontal rod is also passed through the hook end of the device. The device is moved into a position having the opening of the spiral end adjacent to the gutter lip. The device is then rotated about the horizontal rod which is within the hook end, in a manner to cause the spiral curvature to firmly engage the gutter lip between the spiral curvature and the body. This will firmly seat the device in a resting position so that the gutter lip is positioned within the opening of the spiral curvature.

The device is particularly adapted to be utilized in conjunction with the horizontal rod mounted at one end of a elongated staff. The device is then positioned above the gutter lip by extending the elongated staff over the gutter from a position remote from the gutter. The hook is held tightly against the gutter wall by the curvature of its spiral shape. This technique allows the application and removal of the device and Christmas lights without using a ladder or requiring any permanent modification of the home.

These and other advantages and features of the present invention will be more fully understood on reference to the presently preferred embodiments thereof and to the appended drawings.

DESCRIPTION OF THE PREFERRED EMBODIMENTS

Figure 1:
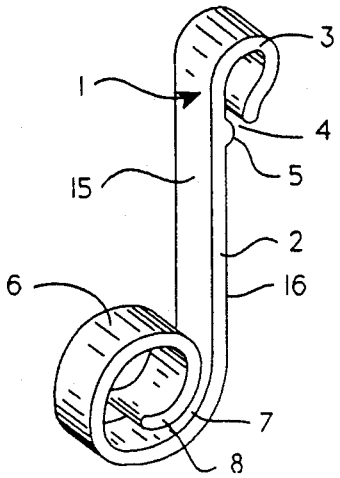
FIG. 1 is an isometric view of my gutter hook.

Referring to FIG. 1, the gutter hook is shown having a flat body member 2 with front face 15. Hook end 3 terminates at a point adjacent to the body member 2, preferably having space 4 therebetween. Spiral end 6 extends from the opposite end of the body member 2, having a proximal point 8 at some point on the curve. Proximal point 8 is adjacent body member 2, preferably having space 7 therebetween. A small projection 5 may be provided to help restrain the cord 10 (see FIG. 3) in the hook 3. I have found that this projection will allow the cord of a Christmas light string to be easily inserted in the hook end of the invention and will also keep the cord from being blown out of the hook by high winds.

Figure 2:
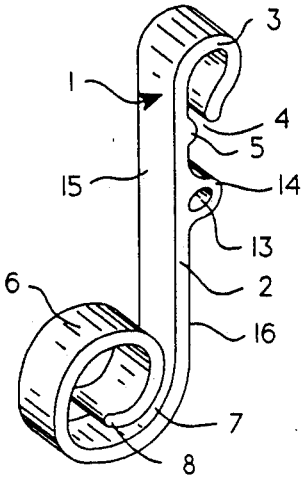
FIG. 2 is an isometric view of a second embodiment of gutter hook.

FIG. 2 illustrates a second embodiment of the invention, having a boss 14 in rear face 16 of body member 2, the boss 14 having a hole 13 therethrough, which is adapted to accommodate a horizontal rod utilized in the mounting of the device as shown in FIGS. 4 through 7.

Figure 3:
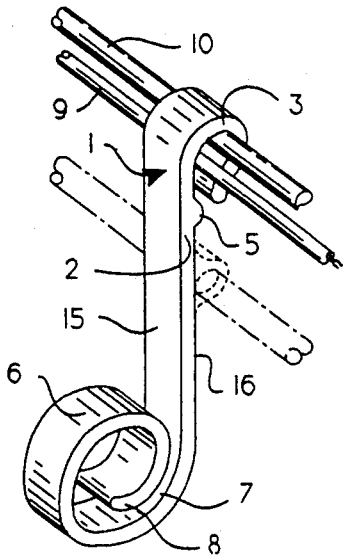
FIG. 3 is an isometric view of the embodiment of FIG. 1, suspended from a horizontal rod.
Figure 4:
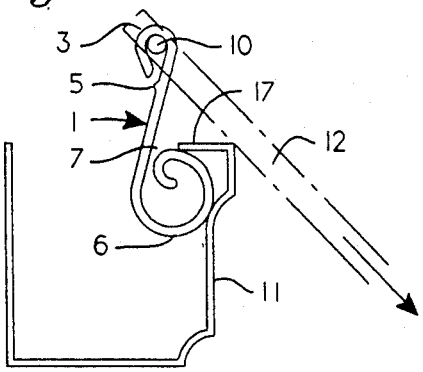
FIGS. 4 through 7 are a diagrammatic progression of the mounting of my gutter hook on a gutter.
Figure 5:
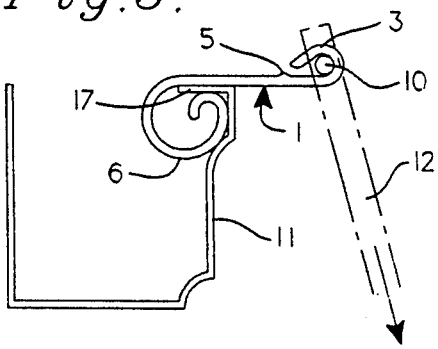
Figure 6:
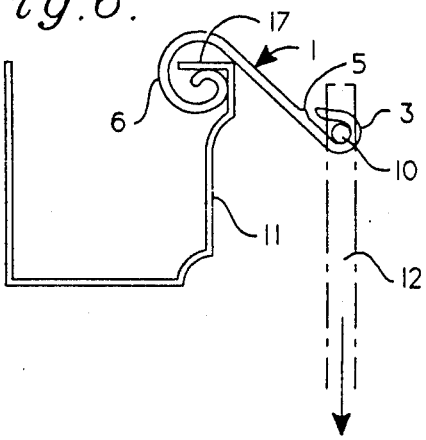
Figure 7:
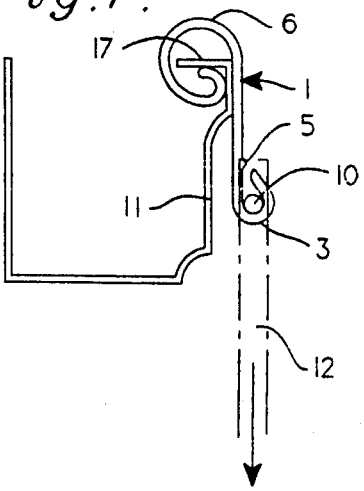

Referring to FIG. 3, the device 1 is suspended from horizontal rod 10, and has a cord 9 passed through hook end 3. Should the embodiment of FIG. 2 be utilized, the rod 10 would be passed through hole 13 as shown in chain line.

Referring to FIGS. 4 through 7, the method of suspending the device from a gutter is displayed. A cord is passed through the hook end 3 (as seen in FIG. 3, not shown here). The device 1 is suspended from horizontal rod 10, which is itself connected to elongated shaft 12. The device 1 is suspended over and inside gutter lip 17, which extends inwardly from the termination of the gutter trough 11. The device 1 is then lowered into the gutter and brought forward so that spiral curvature 6 is in contact with the inside face of gutter lip 17. The device 1 is positioned so that the opening 7 of the device 1 is facing the leading edge of the gutter lip 17. The device 1 is then rotated around the horizontal rod 10 in the hook end 3 by pulling downward on the elongated shaft 12 and maintaining contact between the spiral curvature 6 and the inside face of gutter trough 11 and gutter lip 17. Gutter lip 17 thus slides into channel 7, distorting the spiral curvature 6 which then grips the gutter lip 17 and the outer surface of gutter trough 11. When the device is fully rotated, and the edge of the gutter lip 17 is fully inserted into space 5, a pull on elongated shaft 12 firmly mounts the device 1 on the gutter lip 17 by pinching the gutter trough 11 between the body member 2 and the proximal point 8. The gutter lip 17 is encompassed in the spiral section 6, which is particularly spaced to accommodate the lip. The horizontal rod 10 and elongated shaft 12 are then removed from the hook end 3 by sliding the horizontal bar 10 out of the hole.

Removal of the device is simply the reversal of the steps previously mentioned, i.e. insertion of the rod into the device, rotation of the device off the gutter lip, and lowering of the device to the ground at the end of the elongated shaft.

While I have described a present preferred embodiment of the invention, it is to be distinctly understood that the invention is not limited thereto but may be otherwise embodied and practiced within the scope of the following claims.

I claim:

1. A device for mounting a cord on a gutter and similar structures comprising a ribbon-shaped body member having a front face, a rear face, and two ends, one end having a hook and a second end having a spiral curvature with a proximal point adjacent to the body, said device adapted to fit over a portion of a gutter lip passed between the proximal point and the body when said proximal point of said spiral curvature is positioned inside said gutter, wherein the device has sufficient size, shape and resilience to enable the spiral end to grip the gutter lip and further comprising a projection located on the body member adjacent to the hook end, such that a cord passed through the hook end is restrained thereby.

2. A device as described in claim 1 wherein the device is plastic.

3. A device as described in claim 1 wherein the hook end is sized so as to accommodate at least one cord and a rod therethrough around which the device may be rotated.

4. A device as described in claim 1 wherein the hook end is a loop-shaped curve having an opening so as to allow a cord to pass therethrough by resilient distortion of the loop.

5. A device as described in claim 1 wherein the spiral end forms a curve so that the spiral continues beyond the proximal point.

6. A device as described in claim 1 wherein the body member further comprises a boss, extending from the front face of the body member, having a hole therethrough.

* * * * *